United States Patent [19]

Krebs

[11] Patent Number: 4,536,994

[45] Date of Patent: Aug. 27, 1985

[54] CURVED SURFACE SANDING DEVICE

[76] Inventor: William T. Krebs, 106 Virginia Ave., Cheraw, S.C. 29520

[21] Appl. No.: 530,062

[22] Filed: Sep. 7, 1983

[51] Int. Cl.[3] ..... B24D 9/00

[52] U.S. Cl. ..... 51/328; 51/360; 51/364

[58] Field of Search ..... 51/358, 359, 360, 361, 51/364, 370, 281 R, 327, 328

[56] References Cited

U.S. PATENT DOCUMENTS

| | | | |
|---|---|---|---|
| 2,100,780 | 11/1937 | Huhn | 51/361 |
| 2,553,432 | 5/1951 | Vendien | 51/364 |
| 3,774,354 | 11/1973 | Taylor | 51/358 |
| 3,877,185 | 4/1975 | Wells | 51/358 |
| 4,213,278 | 7/1980 | Oberer | 51/370 X |

FOREIGN PATENT DOCUMENTS

| | | | |
|---|---|---|---|
| 870588 | 6/1941 | United Kingdom | 51/361 |

*Primary Examiner*—Robert P. Olszewski
*Attorney, Agent, or Firm*—Wigman & Cohen

[57] ABSTRACT

A device comprising a slotted cylindrical tube mounted on a mandrel is used to sand curved and irregular surfaces. This is achieved by wrapping an abrasive paper strip around the tube. The strip is locked in place by making a fold in the abrasive strip and inserting both of its ends through the slot, around the mandrel, and back through the slot again. The mandrel is designed to fit within a drill chuck.

2 Claims, 2 Drawing Figures

CURVED SURFACE SANDING DEVICE

BACKGROUND OF THE INVENTION

The present invention relates to improvements in sanding tools and more particularly to a cylindrical sanding device suitable for use on curved and irregular surfaces and capable of being mounted in a drill or tool chuck.

Sanding devices currently in use pose several problems. First, by its very nature, sandpaper wears down very quickly thus requiring an operator to replace it at frequent intervals. Even where the sandpaper is not yet worn out, it is often necessary to switch from a coarse to a fine grade of paper in order to complete a job properly. Because of this necessity for frequent replacement of sandpaper, it is highly desirable that a sanding device be easily loaded and unloaded. At the same time however, the strong tangential forces which act upon an abrasive rotating head require that the paper be held securely.

In order to obtain a secure hold, the devices disclosed in the prior art have required special attaching means which have added a great deal to their cost of production while making the process of loading and unloading abrasive paper much more difficult. For example, the cylindrical sanding head of the device disclosed in U.S. Pat. No. 3,774,354 requires a screw to hold the abrasive paper strip in place. More specifically, the insertion of a screw through one side of the cylinder forces a central mandrel against the other side thereby effecting a hold on a strip of abrasive paper located therebetween.

Likewise, the device described in U.S. Pat. No. 1,319,417 requires a pair of radially opposed arms to hold the abrasive strip securely onto the cylindrical sanding head. The arms are forced against the strip by a threaded rotating sleeve means attached to the end of the cylinder.

Finally, in order to securely hold the abrasive strip on the cylindrical sanding head disclosed in U.S. Pat. No. 4,067,149, the strip must have an adhesive backing. An end of this strip is inserted into a longitudinally extending slot in the cylindrical head. Although achieving a strong hold, this arrangement makes it difficult to switch back and forth between different grades of sandpaper.

An alternative type of sanding device which securely holds the sandpaper and permits easy replacement of the spent paper is disclosed in U.S. Pat. Nos. 2,174,945 and 2,366,158. In these devices, a roll of paper is mounted on a mandrel internal to the cylindrical head tube. One end of the paper is attached to the mandrel and the other end is guided through a slot disposed longitudinally along the tube. When the paper outside the circumference of the tube becomes worn out, it is simply torn off and replaced by paper from the roll. The problem with these devices however is that a considerable effort is required to replace one kind of paper with another kind. Thus, an operator who desires to switch from a rough to a finer grade of paper must disassemble nearly the entire device to do so.

SUMMARY AND OBJECTS OF THE INVENTION

In view of the foregoing limitations and shortcomings of the prior art devices, as well as other disadvantages not specifically mentioned above, it should be apparent that there still exists a need in the art for a sanding device of simple and sturdy construction which fits into a drill or other tool chuck and which, while allowing for easy insertion and removal of sandpaper, can maintain a firm hold on the paper during the sanding process.

It is therefore a primary object of this invention to fulfill that need by providing a two piece sanding device which is self-locking and requires no special attachments to firmly hold a strip of sandpaper therein.

It is another object of this invention to provide a sanding device in which it is easy to insert and remove the sandpaper.

Yet another object of this invention is to provide a device of very simple construction which is inexpensive to manufacture.

Still another object of this invention is to provide a sanding device capable of fitting into a drill or tool chuck.

Another object of this invention is to provide a method of sanding curved surfaces which is easy and effective.

Briefly described, the aforementioned objects are accomplished in this invention by providing a cylindrical tube coaxially mounted on a mandrel. The mandrel is adapted to fit within a drill or tool chuck. The tube has a longitudinal slot which, together with the space between the tube and the mandrel, defines a path in which an abrasive paper strip may be inserted.

Because the tube is open-ended, it is very easy to insert the paper strip into the defined path. At the same time however, the portion of the strip coming through the slot will be locked in place when a tangential force is applied thereto.

With the foregoing and the other objects, advantages and features of the invention that will become hereinafter apparent, the nature of the invention may be more clearly understood by reference to the following detailed description of the invention, the appended claims and to the views illustrated in the attached drawings.

DETAILED DESCRIPTION OF A PREFERRED EMBODIMENT

Figure 1:
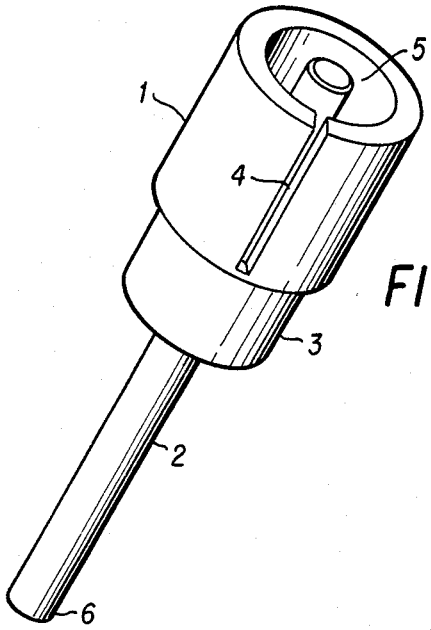
FIG. 1 is a perspective view of the sanding device.

Referring now in detail to the drawings wherein like parts are designated by like reference numerals throughout, the preferred sanding device is shown in FIG. 1. It comprises a cylindrical tube 1 mounted on a coaxial mandrel 2. The tube 1 has a longitudinal slot 4. A portion 3 of the tube 1 is of reduced diameter, and unslotted. The mandrel 2 is attached to the tube 1 at the tube's reduced diameter portion 3. The end 6 of the mandrel 2 may be inserted into the chuck of a drill. In the preferred embodiment, the inner diameter of the tube 1 is only slightly greater than the diameter of the mandrel 2, so as to define a circular space 5 large enough to easily accommodate the insertion of the paper strip 7. This arrangement achieves the firmest hold.

The preferred materials for the sanding device are glass reinforced nylon for the tube 1 and cold rolled steel for the mandrel 2 although other materials may be used. If desired, the device could also be constructed of a one piece plastic molding rather than a separate mandrel and tube. The mandrel 2 should be of a small enough diameter so as to fit within the chuck of a drill.

To use the above-described device, a fold should be made along the width of a strip of sandpaper 7. This fold should then be inserted around the top of the mandrel 2, with both sides of the fold coming through the slot 4. Although the strip 7 can be easily lifted off the mandrel 2, it has been found that a tangential force applied to either side of the fold coming out of the slot 4 is ineffective to remove the strip 7. The strip 7 is effectively locked against tangential forces.

Figure 2:
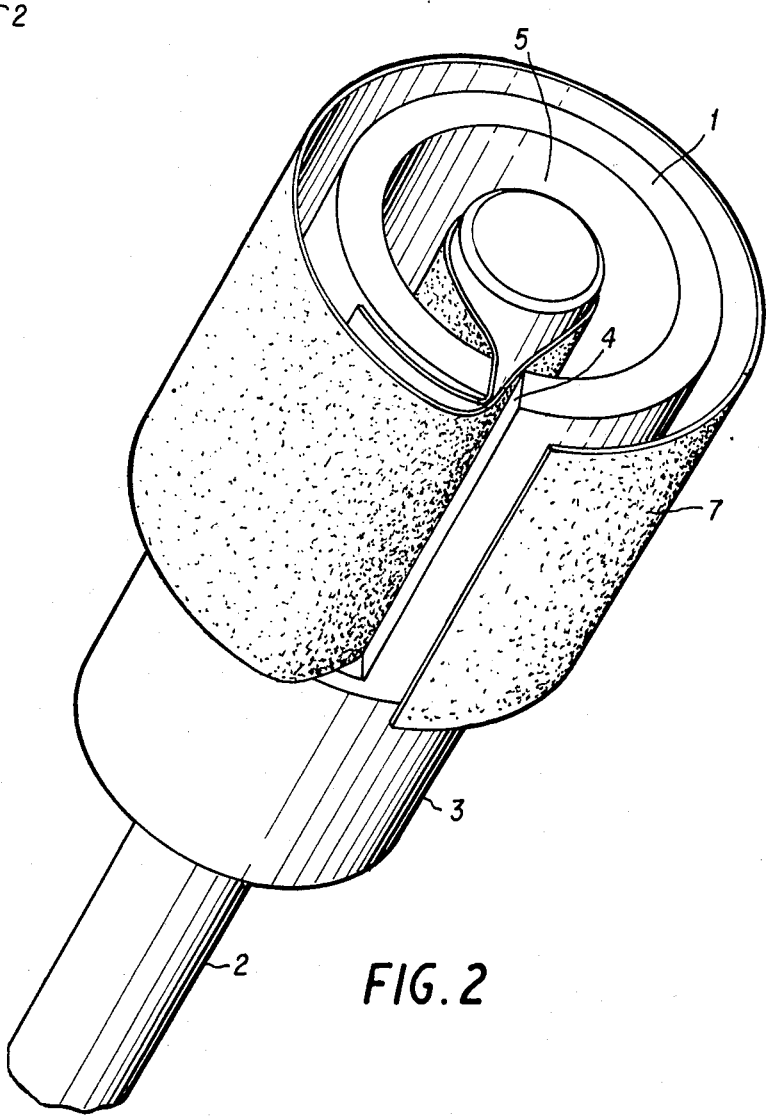
FIG. 2 is another perspective view showing the device in operation.

One side of the fold coming through the slot 4 should be at least of a length corresponding to the circumference of the tube 1, whereas the other side need only extend a slight distance from the slot 4. This is clearly shown in FIG. 2. The width of the sandpaper 7 should substantially correspond to the length of the slot 4.

After the strip 7 has been wrapped around the tube 1, the mandrel 2 may be inserted into a drill or tool chuck. It has been observed that when the rotating sanding device comes in contact with an object, the free end of the strip 7 is held firmly against the tube 1. If desired, the strip 7 may be of a great enough length so as to wrap around the tube 1 in several layers. When the outer layer becomes worn out, it is simply torn off to expose a layer of fresh paper.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A method of sanding curved surfaces using a self-locking sanding device, said method comprising the steps of:

making a fold in a strip of abrasive paper;

inserting said fold around a mandrel and through a longitudinal slot of a tube coaxial to and surrounding said mandrel such that the abrasive paper strip on both sides of said fold extends through said slot to the outside of said tube;

wrapping said abrasive paper strip around said tube such that both sides of the fold extend at least partially around said tube;

inserting an end of said mandrel into a drill chuck; and operating said self-locking sanding device to sand an object, whereby said abrasive paper strip is positively locked in place by the forces acting thereon during said operation.

2. The method of claim 1, further including the step of tearing off a worn out layer of said strip to expose a new layer.

* * * * *